US006435115B1

(12) United States Patent
Yoshikazu et al.

(10) Patent No.: US 6,435,115 B1
(45) Date of Patent: Aug. 20, 2002

(54) EMBROIDERING SEWING MACHINE

(75) Inventors: Ebata Yoshikazu; Omiya Koshiro; Ninomiya Masashi; Takenoya Hideaki, all of Tokyo (JP)

(73) Assignee: Janome Sewing Machine Co., Ltd., Tokyo (JP)

( * ) Notice: Subject to any disclaimer, the term of this patent is extended or adjusted under 35 U.S.C. 154(b) by 4 days.

(21) Appl. No.: 09/604,351

(22) Filed: Jun. 27, 2000

(30) Foreign Application Priority Data

Jul. 9, 1999 (JP) ..... 11-196730
Jul. 9, 1999 (JP) ..... 11-196731
Nov. 19, 1999 (JP) ..... 11-330654

(51) Int. Cl.[7] ..... D05C 5/02; D05B 21/00
(52) U.S. Cl. ..... 112/103
(58) Field of Search ..... 112/102.5, 103, 112/470.06, 475.19

(56) References Cited

U.S. PATENT DOCUMENTS 4,499,838 A * 2/1985 Voza ..... 112/475.19
5,003,895 A * 4/1991 Talanker ..... 112/103

* cited by examiner

*Primary Examiner*—Peter Nerbun
(74) *Attorney, Agent, or Firm*—Nields & Lemack

(57) ABSTRACT

An embroidering sewing machine comprising a needle vertically reciprocated to stitch a work; an embroidering frame for holding the work to be stitched; a base (2) enclosed to provide a predetermined space therein; a driver means arranged in the base (2) and including a carriage assembly operatively connected to the embroidering frame and operated in synchronism with vertical movement of the needle to move in X-direction and in Y-direction normal to X-direction, the carriage assembly including a base carriage (5) movable in X-direction, an intermediate carriage (6) operatively connected to the base carriage (5) to move therewith and being movable in Y-direction relative to the base carriage (5), a distal end carriage (7) operatively connected to the intermediate carriage (6) to move therewith; a transmission means arranged between the intermediate carriage (6) and the distal end carriage (7) and transmitting the movement of the intermediate carriage (6) to the distal end carriage (7) to move the distal end carriage (7).

23 Claims, 17 Drawing Sheets

Y
X
20
7c
7
10b
11
Fb
6a
6
13
11
Fa
12
6b
6c
10a
8a
5a
5b2
5
5a1
6c
8b
9
6d
15
6c
14
5b1
5a1
5a1
8b
9
15
5b1
12
5a
8a
14
5b2
5a1
5

EMBROIDERING SEWING MACHINE

BACKGROUND OF THE INVENTION

1. Field of the Invention

The present invention relates to a sewing machine, more particularly relates to an embroidering sewing machine having a needle vertically reciprocated relative to a work held on an embroidering frame to be stitched and an embroidering frame driver including a carriage which is operatively connected to the embroidering frame and is operated in synchronism with vertical reciprocation of the needle to move in a first direction and in a second direction normal to the first direction, thereby to move the embroidering frame in accordance with the movement of the carriage relative to the needle.

2. Prior Art

It has been generally known that the embroidering sewing machine has a driver for drivingly moving embroidering frame holding a work to be stitched. The embroidering frame driver includes a carriage operatively connected to the embroidering frame and is operated in synchronism with vertical reciprocation of the needle to move in a first direction (X-direction) and in a direction (Y-direction) normal to the first direction. The embroidering frame driver is normally arranged in a base of the sewing machine or in a casing which is separated from the sewing machine. In any case, the carriage is partly extended out of the base or the casing to hold the embroidering frame which is to be moved in accordance with movement of the carriage relative to the needle.

Therefore, the area where the embroidering frame driver including a carriage can move is determined by the size of sewing machine or by the size of the embroidering frame driver because the embroidering frame driver can not move the machine beyond a limited size of the base of the sewing machine or a limited size of separate casing in which the embroidering frame driver is housed. This makes it impossible to continuously stitch a large sized pattern without interruption of stitching operation. In order to stitch a large sized pattern, it has been required to reset the work to the embroidering frame so often while the sewing machine is stopped until the pattern is completed.

For the purpose of solving this problem, it has been designed to enlarge the base of sewing machine or the separate casing in which the embroidering frame is housed, thereby to enlarge the area where stitching operation is performed. Such a sewing machine will be inevitably bulky and heavy and, therefore, will not be adapted to being used in the houses in general.

OBJECT OF THE INVENTION

The invention has been provided to eliminate the defects and disadvantages of the prior art.

It is, therefore, an object of the invention to provide an embroidering sewing machine which may stitch a large sized pattern continuously without interruption of stitching operation halfway for resetting a work to the embroidering frame.

It is another object of the invention to provide an embroidering sewing machine which is compact is structure and smooth in operation.

It is another object of the invention to provide a embroidering sewing machine including a carriage assembly which accomplish a amplified motion exceeding the size of the carriage assembly per se.

It is still another object of the invention to make it possible to use a relatively large sized embroidering frame to stitch a relatively large sized pattern.

SUMMARY OF THE INVENTION

For attaining the objects, the embroidering sewing machine of the invention having an embroidering frame for holding the work to be stitched, comprises a first drive means operated in synchronism with vertical reciprocating movement of a needle to move the embroidering frame in a first direction and a second drive means operated in synchronism with vertical reciprocating movement of the needle to move the embroidering frame in a second direction normal to the first direction, wherein: at least one of said first and second drive means comprises; a movable means which reciprocatingly moves in a limited area in said first or second direction, and a motion amplifying means to amplify the movement of said movable means and transmit it to said embroidering frame, thereby to move said embroidering frame in the range exceeding said limited area.

DETAILED DESCRIPTION OF THE PREFERRED EMBODIMENTS

Figure 1:
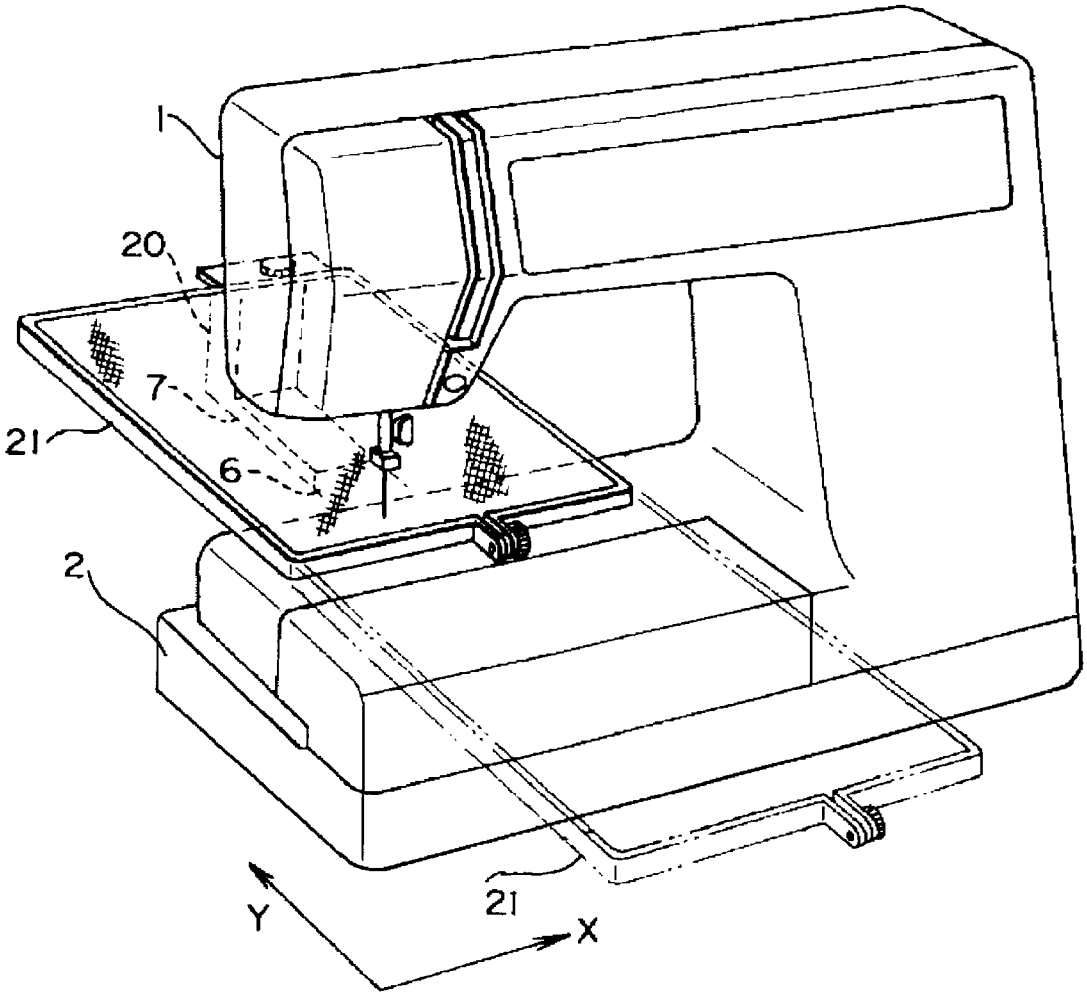
FIG. 1 is a perspective view of an embroidering sewing machine according to the invention.
Figure 2:
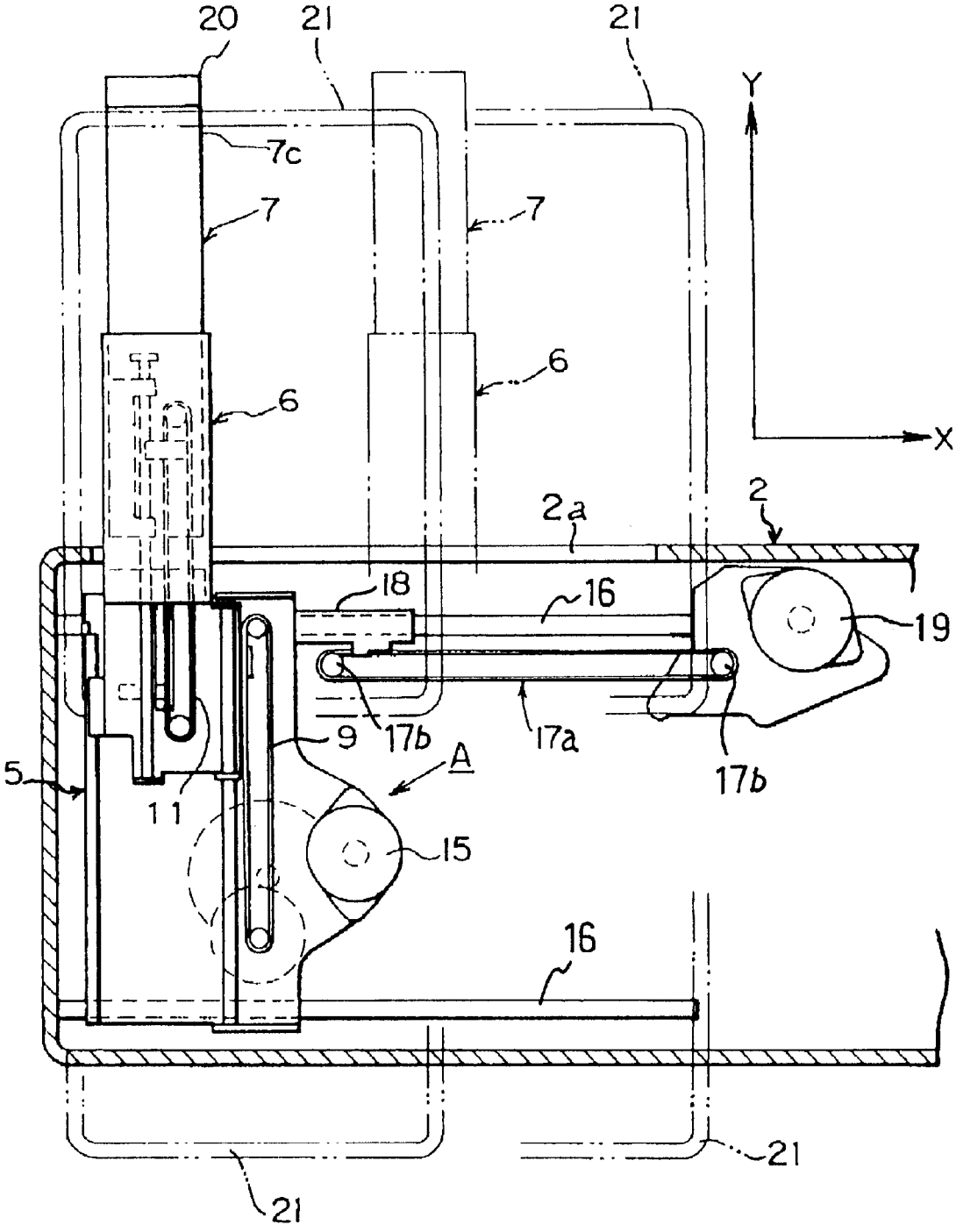
FIG. 2 is a plan elevational view of a base of the sewing machine laterally sectioned to show the interior thereof.

The invention will now be described in reference to the attached drawings. FIG. 1 shows the outline of a sewing machine. FIG. 2 is a plan elevational view of a base 2 of the sewing machine shown in lateral section to show the interior thereof wherein a X-Y drive device A is housed.

In an arm 1 of the sewing machine, there is provided a stitching device including a rotary drive shaft and a needle bar which is vertically reciprocated in association with rotation of the drive shaft.

The arrow X shows a width direction of the sewing machine while arrow Y shows a depth direction of the sewing machine.

The drive device A has a portion 20 to which an embroidering frame 21 is attached rearwardly of the base 2 in the direction Y. The embroidering frame attaching portion 20 is extended out of the base 2 through a guide groove 2*a* formed at the rear side of the base 2. such that the embroidering frame 21 attached to the embroidering frame attaching portion 20 may be moved by the drive device A in the directions X and Y.

The embroidering frame attaching portion 20 is an extension end of an distal end carriage 7 which forms a carriage structure together with an intermediate carriage 6 and a base carriage 5 which is moved by a drive motor 19 only in the direction X.

Figure 3:
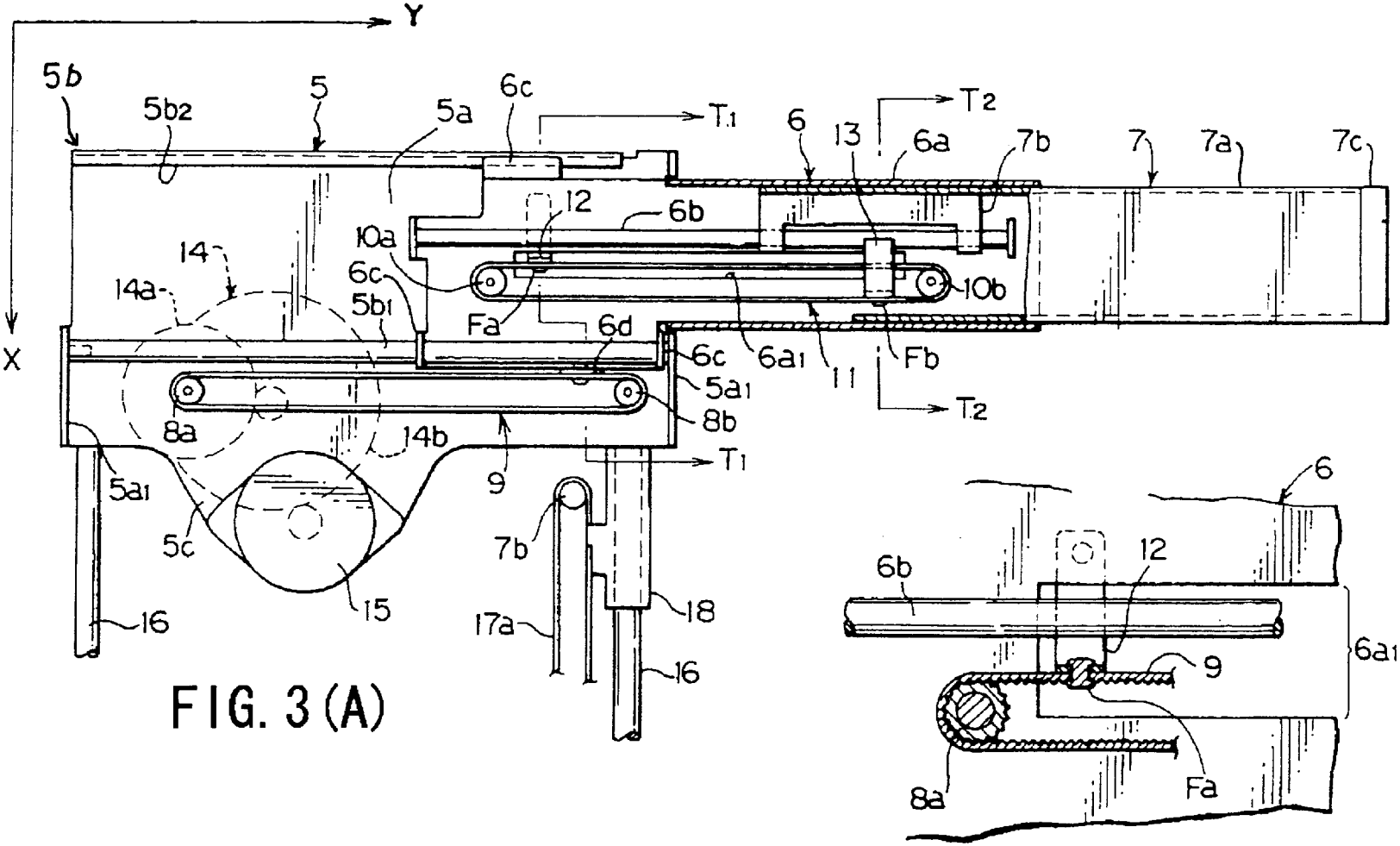
FIG. 3(A) is an enlarged plan elevational view of a carriage drive device of the sewing machine.
FIG. 3(B) is a further enlarged plan elevational view of an essential part of the carriage drive device of the sewing machine.

As shown in FIG. 3(A), the base carriage 5 is composed of a flat plate 5*a* extended in the direction Y and having a sectionally circular guide shaft 5*b*1 and a guide rail 5*b*2 which is located opposite to the guide shaft 5*b*1 in the direction X, the guide shaft and guide rail extending in the direction Y respectively. The guide shaft 5*b*1 is supported by beatings 5*a*1, 5*a*2 formed at the opposite sides of the flat plate 5*a* in the direction Y by bending up the flat plate 5*a* while the guide rail 5*b*2 is formed by bending up the flat plate 5*a* and further horizontally bent inside above the flat plate 5*a*.

The flat plate 5*a* has a pair of opposite pulleys 8*a*, 8*b* spaced from each other in the direction Y. An endless belt 9 is wound around the pulleys 8*a*, 8*b* and is extended in parallel with the guide shaft 5*b*1.

One of the pulleys 8*a*, 8*b* is operatively connected to a drive motor 15 through a gear assembly 14, the drive motor 15 being supported on lower side of the flat plate 5*a*. The drive motor 15 is driven to rotate one of the pulleys 8*a*, 8*b*, thereby to move the endless belt around the pulleys 8*a*, 8*b*. The gear assembly 14 includes a plurality of gears including an intermediate gear 14*b* in mesh with a drive gear of the motor 15 and a follower gear 14*a* which is in mesh with the intermediate gear 14*b* and coaxial with the pulley 8*a* to rotate the pulley 8*a* at a reduced speed, thereby to reduce the moving speed of the endless belt 9 which is moved around the pulleys 8*a*, 8*b*.

Figure 4:
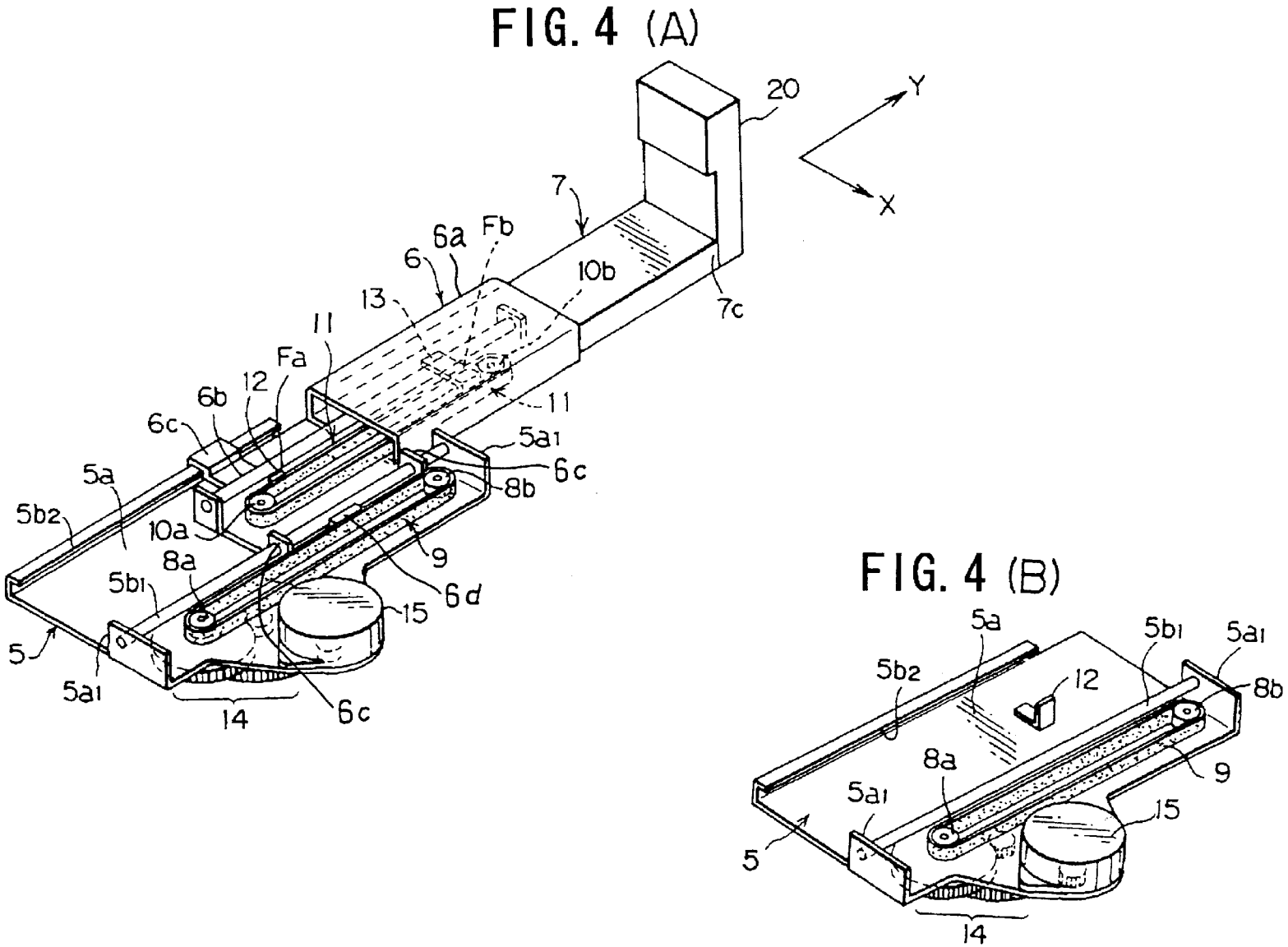
FIG. 4(A) is an enlarged perspective view of the carriage drive device composed of a base carriage, an intermediate carriage, a distal end carriage and transmission belts.
FIG. 4(B) is a perspective view of a part of the carriage drive device.

As shown in FIG. 4(A), the intermediate carriage 6 has guide portions 6*c* formed at the opposite sides thereof in the direction X. One of the engaging portions 6*c* is in engagement with the guide rail 5*b*2 while the other two engaging portions 6*c* are in engagement with the guide shaft 5*b*1. The intermediate carriage 6 has a portion 6*d* fixedly connected to the endless belt 9 at a connecting point indicated by Fo in FIG. 5(A) through FIG. 5(C) such that the intermediate carriage 6 may be reciprocatingly moved relative to the base carriage 5 in the direction Y as guided by the guide shaft 5*b*1 and the guide rail 5*b*2 when the drive motor 15 is driven.

The intermediate carriage 6 is a flat plate partly formed with a hollow frame 6*a* extending in the direction Y and further has a pair of opposite pulleys 10*a* located thereon spaced from each other in the direction Y. An endless belt 11 is wound around the pulleys 10*a*. The endless belt 11 is fixedly connected to the base carriage 5 at a point Fa defined as a connecting point. Precisely a connector 12 fixedly provided on the base carriage 5 as shown in FIG. (4B) is fixedly connected to the belt 11 at one of the opposite sides thereof with the spaced pair of pulleys 10*a* located therebetween.

Figure 5:
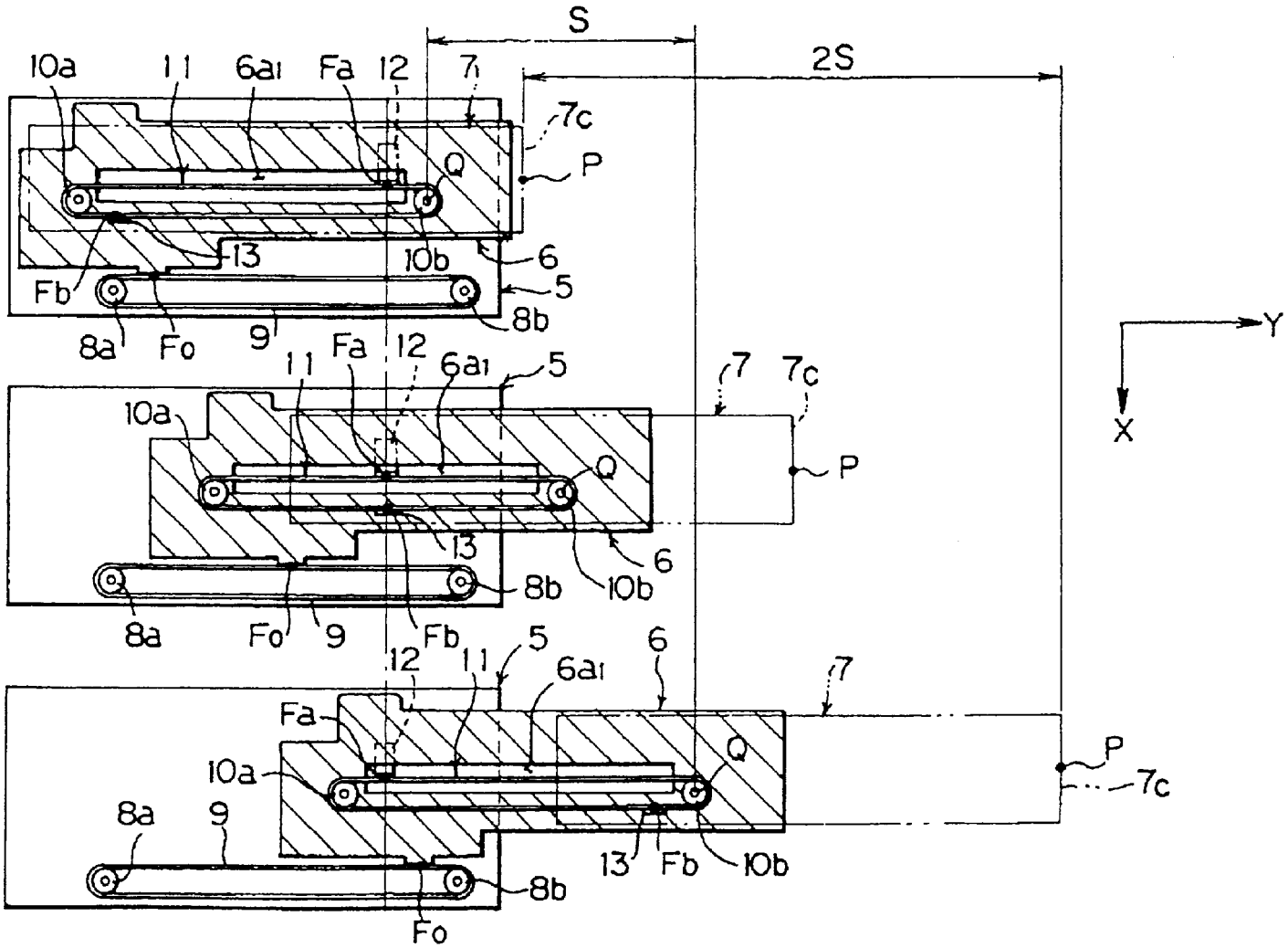
FIG. 5(A) through FIG. 5(C) are plan elevational views of the carriage drive device for explaining the operations thereof.

As shown in FIG. 5(A) through FIG. 5(C), the connector 12 is extended up through an elongated opening 6*a*1 formed at the flat plate of the intermediate carriage 6 and extending in the direction Y in parallel with the endless belt 11. The length of the elongated opening 6*a*1 is more than the length of stroke of the intermediate carriage 6 in the direction Y.

Since the endless belt 11 is fixedly connected to the base carriage 5 at the point Fa which is located at one of the opposite sides of the endless belt 11 with the spaced pair of pulleys 10*a* located therebetween, the endless belt 11 is moved around the pulleys 10*a* as the intermediate carriage 6 is reciprocatingly moved in the direction Y relative to the base carriage 5.

The distal end carriage 7 is operatively connected to the intermediate carriage 6 and is reciprocatingly moved relative thereto in the direction Y into and out of the hollow frame 6*a* of the intermediate carriage 6.

The distal end carriage 7 is composed of an elongated flat hollow frame 7*a* extending in the direction Y and inserted into the hollow frame 6*a* of the intermediate carriage 6 and having an upstanding free end 20 to which an embroidering frame is attached. The distal end carriage 7 has an engaging portion 7*b* which is in sliding engagement with a guide shaft 6*b* provided on the intermediate carriage 6 and extending in the direction Y. The distal end carriage 7 is further fixedly connected to the endless belt 11 at a point Fb which is located at the other of the opposite sides of the endless belt 11 with a pair of spaced pulleys 10*a* being located therebetween. Precisely the distal end carriage 7 has a connector 13 formed thereon and fixedly connected to 7 the endless belt 11 at the point Fb as shown in FIG. 5(A) through FIG. 5(C).

It is preferred to provide one of the connecting point Fa and Fb at a position adjacent to one of the pulleys 10*a* and 10*b* and provide the other of the connecting point Fa and Fb at a position adjacent to the other of the pulleys 10*a* and 10*b*. With the connecting points Fa and Fb being thus positioned, the opposite sides of the endless belt 11 will obtain effective strokes respectively in the movements of opposite directions.

For example, as shown in FIG. 5(A), when the connecting point Fa is moved to the position adjacent to the pulley 10*b* while the endless belt 11 is moved, the connecting point Fb is moved to the position adjacent to the pulley 10*a*. The positional relation is contrary as shown in FIG. 5(C). Thus the connecting point Fb may be moved substantially the length of the endless belt 11 between the opposite pulleys 10*a* and 10*b* in the direction Y. Namely the intermediate carriage 6, which is connected to the endless belt 11 at the connecting point Fa, may be reciprocatingly moved substantially the length of the endless belt 11 relative to the base carriage 5 between the opposite pulleys 10*a* and 10*b* in the direction Y. Therefore, the distal end carriage 7 connected to the endless belt 11 at the connecting point Fb may be reciprocatingly moved substantially the length of the endless belt 11 between the opposite pulleys 10*a* and 10*b* in the direction Y.

In this connection, the endless belt 11 is toothed and is in mesh with the toothed pulley as shown in FIG. 3(B). However, the toothed belt may be replaced by a flat, V-belt or a wire in combination with the correspondingly designed pulley.

The base carriage 5 carrying the intermediate carriage 6 may be moved in the direction X by a drive motor 19 supported on the base plate 5*a* of the base carriage 5 as shown in FIG. 2 and FIG. 3(A). The base carriage 5 is supported at the opposite ends thereof in the direction Y on a pair of spaced guide rails 16, 16 extending in the direction X. The base carriage 5 has an engaging portion 18 secured thereto and extending in the direction Y and being in slide engagement with the guide shaft 16. The engaging portion 18 is fixedly connected to an endless belt 17*a* which is wound around a pair of pulleys 17*b* which are spaced from each other in the direction X. One of the pulleys 17*b* is operatively connected to the drive motor 19 and is rotated thereby such that the endless belt 17*a* may be moved around the pulleys 17*b* , thereby to move the base carriage 5 in the direction Y. Therefore, the end portion 20 of the distal end carriage 7 extended out of the base 2 through the guide groove 2*a,* to which an embroidering frame is attached, may be moved in the directions X and Y.

According to the embodiment of the invention, a single stage of carriage drive mechanism is disclosed including the intermediate carriage 6 and the distal end carriage 7. It is, however, possible to occasionally provide a multi-stage of carriage drive mechanisms including plural set of the intermediate carriage 6 and the distal end carriage 7 to further increase the moving distance of the carriage carrying an embroidering frame.

The operations of the embodiment will now be described in reference to FIG. 5(A) through FIG. 5(C).

The intermediate carriage 6 is moved in the direction Y by the endless belt 9 which is operatively connected to the drive motor 15 and is moved thereby, the drive motor 15 being supported on the base carriage 5 and driven by control signal supplied from a control device (not shown).

Since the endless belt 11 is fixedly connected to the base carriage 5 at the point Fa, the endless belt 11 is moved in the direction Y around the pullets 10*a* and 10*b* as the intermediate carriage 6 is moved in the direction Y.

As shown in FIG. 5(B), in case the intermediate carriage 6 is moved in the right direction from the position as shown in FIG. 5(A), the connecting point Fb, which is located on the opposite side of the connecting point Fa, is moved in the same direction with the intermediate carriage 6. It is, therefore, apparent that the distal end carriage 7, which is fixedly connected to the endless belt 11 at the point Fb, is moved while the intermediate carriage 6 is moved and remains stopped while the intermediate carriage 6 is stopped.

Actually the distal end carriage 7 is moved in association with the movement of the endless belt 11. Therefore, the moving amount of the distal end carriage 7 is determined by the moving amount of the endless belt 11 moving around the two pulleys 10*a* and 10*b*. Namely the movement amount of the distal end carriage 7 is equivalent to the moving amount of the endless belt 11. Since the endless belt 11 is rotationally moved around the pulleys 10*a* and 10*b* and the opposite sides of the endless belt 11 are moved substantially in parallel with each other in the direction Y, one side moving in one direction while the opposite side moving in the opposite direction, it is apparent that the moving amount of one side of the endless belt 11 is equivalent to the moving amount of the opposite side of the endless belt 11. Thus movement amount of the endless belt 11 is twice of the moving amount of the intermediate carriage 6. Therefore, the movement amount of the distal end carriage 7 is twice of the moving amount of the intermediate carriage 6. Namely provided that the moving amount of the intermediate carriage 6 is S, the movement amount of the distal end carriage 7 is 2S.

More precisely, provided that the axial center of the pulley 10*b* is a reference moving point Q of the intermediate carriage 6, the point Q is moved with a maximum stroke S indicating a maximum moving amount of the intermediate carriage 6 from the position as shown in FIG. 5(A) where the intermediate carriage 6 is completely housed in the base carriage 5 to the position as shown in FIG. 5(C) where the intermediate carriage 6 has been moved in maximum.

On the other hand, provided that the distal end 7*c* of the distal end carriage 7 is a reference moving point P of the distal end carriage 7, the point P is moved with a maximum stroke 2S indicating a maximum moving amount of the distal end carriage 7 from the position as shown in FIG. 5(A) where the distal end carriage 7 is completely housed in the base carriage 5 to the position as shown in FIG. 5(C) where the distal end carriage 7 has been moved in maximum.

Thus it is possible to obtain, in the direction Y an extremely increased moving amount of the distal end carriage 7 having the distal end 20 to which an embroidering frame is attached, the distal end carriage 7 being otherwise placed under limitation of movement in the base 2 of sewing machine.

Subsequently, a second embodiment of the invention will be described.

According to the second embodiment, there is provided a carriage assembly including a carriage 44 and a distal end carriage 47 operatively connected to the carriage 44 and being capable of moving in X and Y directions. The distal end carriage 47 has a distal end 47*a* to which an embroidering frame is attached by means of an adapter 53.

A pair of guide rails 35, 35' are provided as extending in the direction X and supported on bearings 37. Another pair of guide rails 36, 36' are provided as extending in the direction Y and supported on bearings 37. A pair of endless belts 38, 38' are provided as extending in the direction Y along the guide rails 35, 35' respectively and wound around a pair of pulleys 40 secured to the guide rails 35, 35' respectively. Another pair of endless belts 39, 39' are provided as extending in the direction Y along the guide rails 36, 36' and wound around a pair of pulleys 40 secures to the guide rails 36, 36' respectively. The pulley 40 are operatively connected to drive motors M respectively and rotated by the motors to move the endless belts there around.

Figure 9:
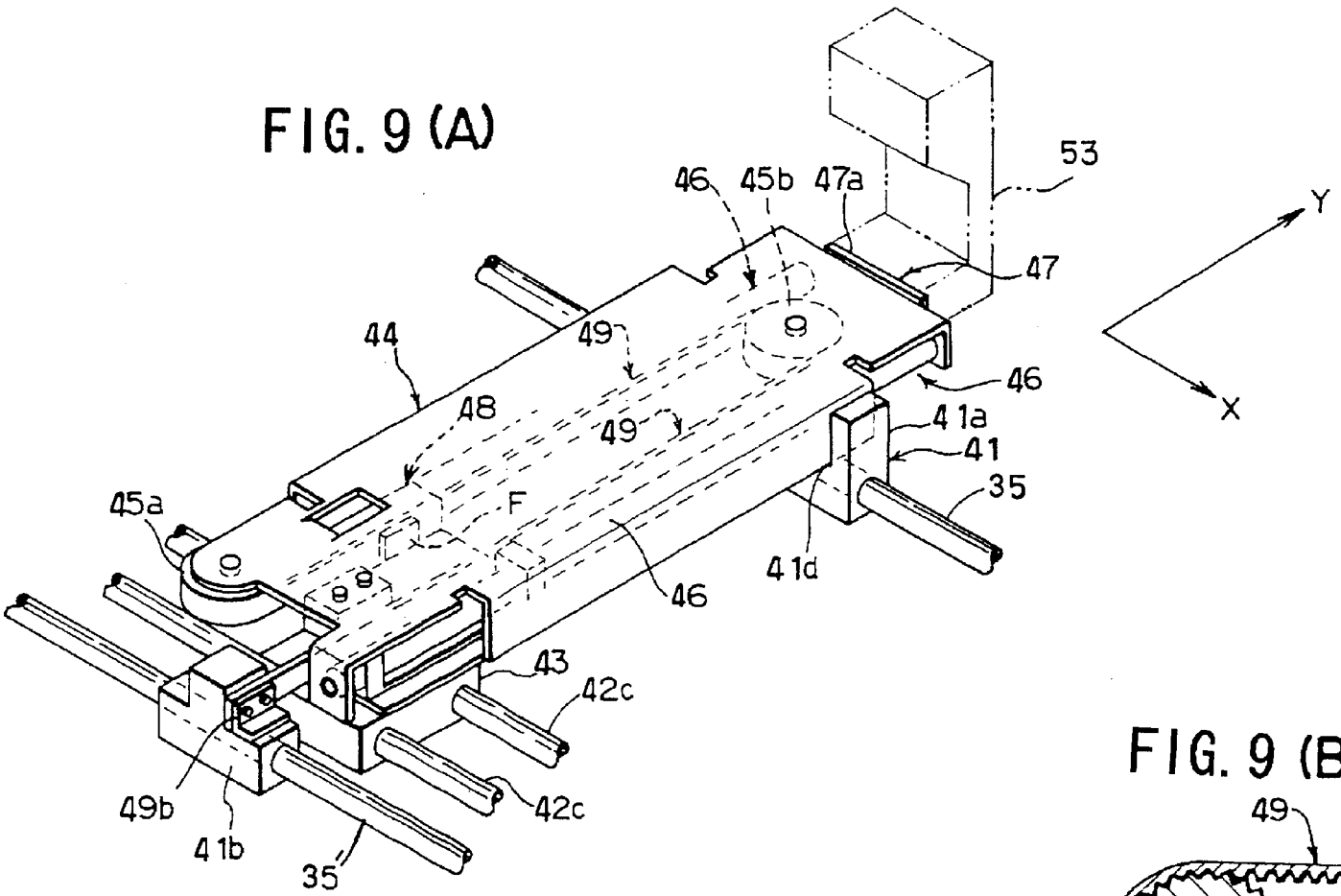
FIG. 9(A) is a perspective view of the carriage drive device shown in combination with X-Y drive mechanism.
FIG. 9(B) is a plan elevational view of a modified embodiment of transmission belt which may be employed in the embodiment.
Figure 9:
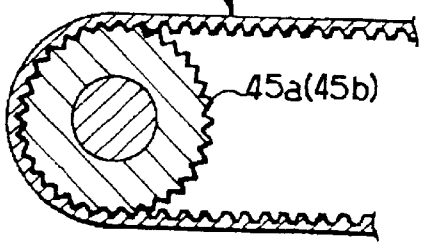
Figure 10:
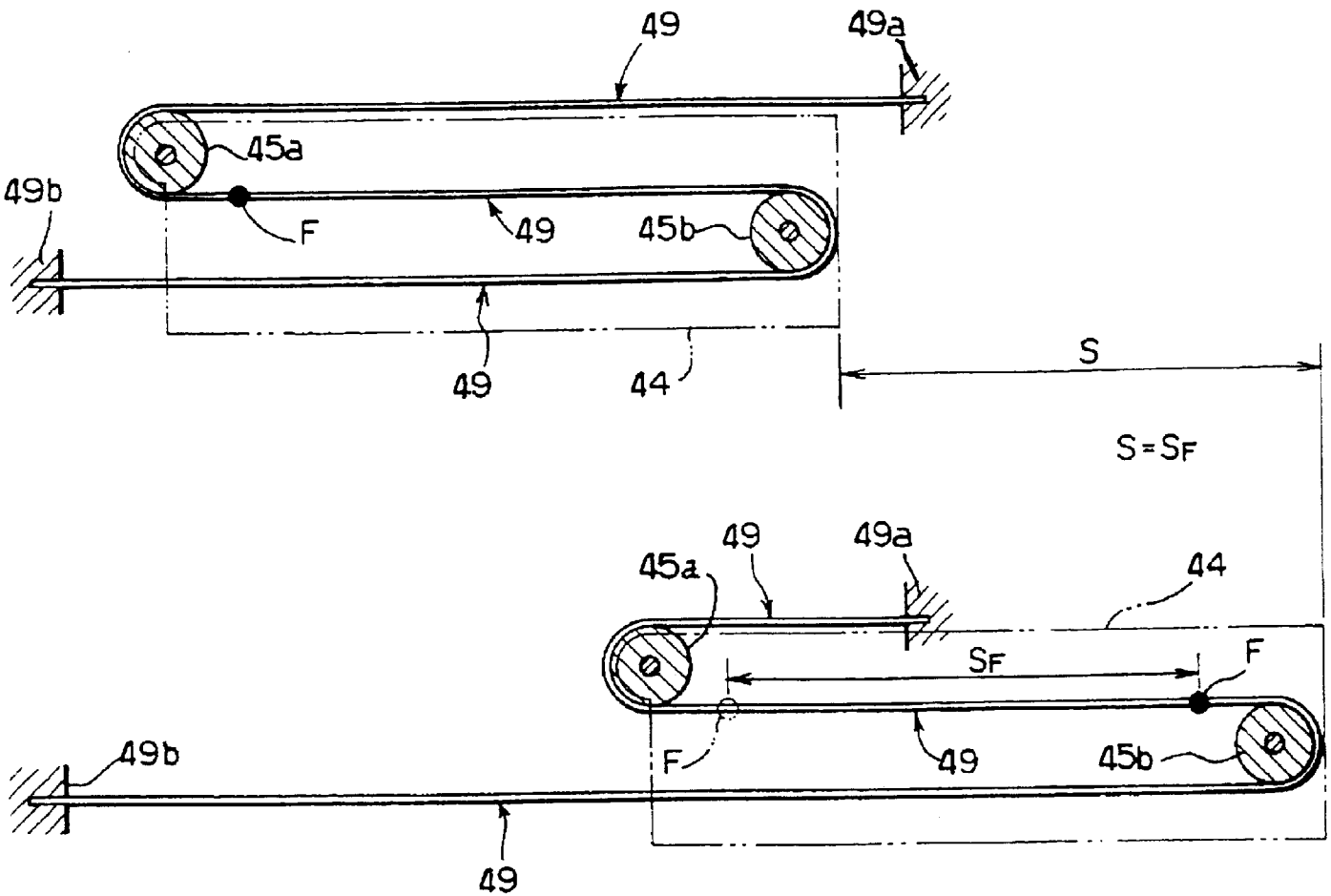
FIG. 10(A) is a plan elevational views of a transmission belt of the carriage drive device shown as is at the initial position.
FIG. 10(B) is a plan elevational views of a transmission belt of the carriage drive device shown as is moved to maximum extent.

As particularly shown in FIG. 9, an X-direction carrier 41 includes slide members 41*a,* 41*b* oppositely located in the direction Y as slidably mounted on the guide rails 35, 35' respectively and a member 41*c* for connecting the two slide members 41*a,* 41*b* . The slide members 41*a,* 41*b* are fixedly connected to the endless belts 38, 38' respectively so as to be slidingly moved along the guide rails 35, 35' as the endless belts 38, 38' are moved.

A Y-direction carrier 42 includes slide members 42*a,* 42*b* oppositely located in the direction X as slidably mounted on the guide rails 36, 36' respectively and guide shafts 42*c* connecting the two slide members 41*a,* 41*b*. The slide members 41*a,* 41*b* are fixedly connected to the endless belts 39, 39' respectively so as to be slidingly moved along the guide rails 35, 35' as the endless belts 39, 39' are moved.

Figure 6:
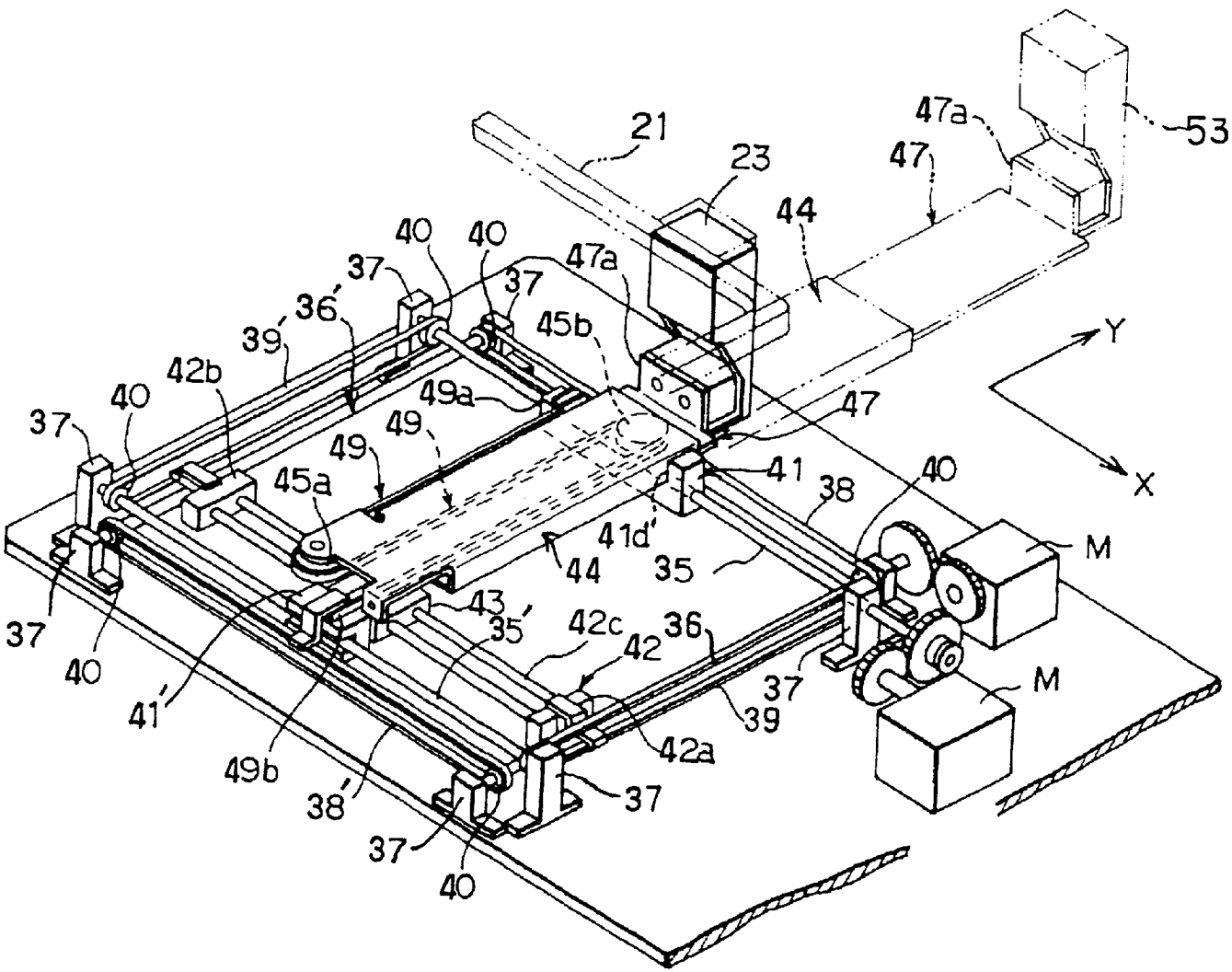
FIG. 6 is a perspective view of a second embodiment of the carriage drive device shown in combination with X-Y drive mechanism.

As shown in FIG. 6, a slide member 43 is mounted on the on the guide shafts 42*c* and is slidingly movable therealong.

The carriage 44 has one end fixedly connected to the slide member 43 and has the opposite end mounted on the carrier 41 so as to be slidingly movable in the direction Y.

Figure 7:
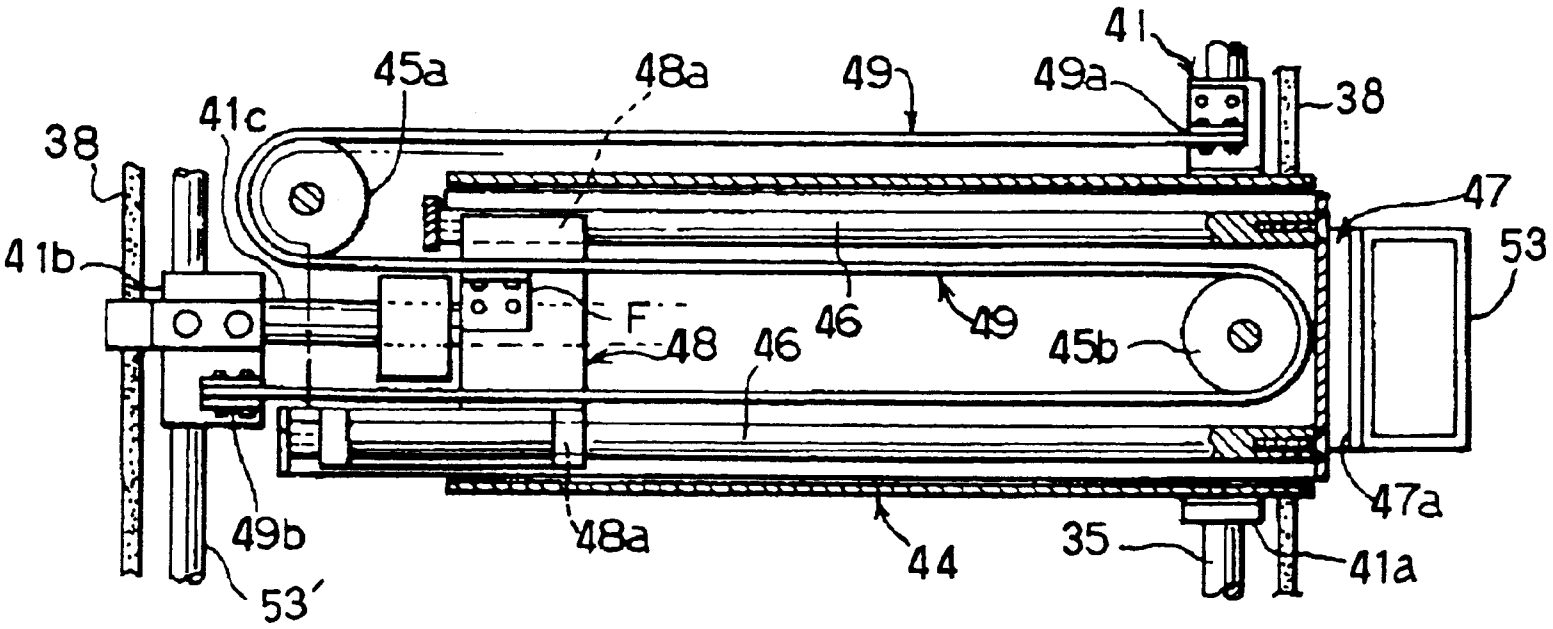
FIG. 7 is a plan elevational view of the carriage drive device shown in lateral section.

As shown in FIG. 7, a pair of pulleys 45*a,* 45*b* are rotatably mounted on the carriage 44 with the central axes thereof being displaced in the direction X in the manner that a tangent line is common to the two pulleys 45*a,* 45*b* and is in alignment with the Y axis. A cord-belt 49 is wound around the pulleys 45*a,* 45*b* in formation generally of S-shape. The belt 49 has one end 49*a* fixedly connected to the slide member 41*a* and the opposite end 49*b* fixedly connected to the slide member 41*b*.

Figure 8:
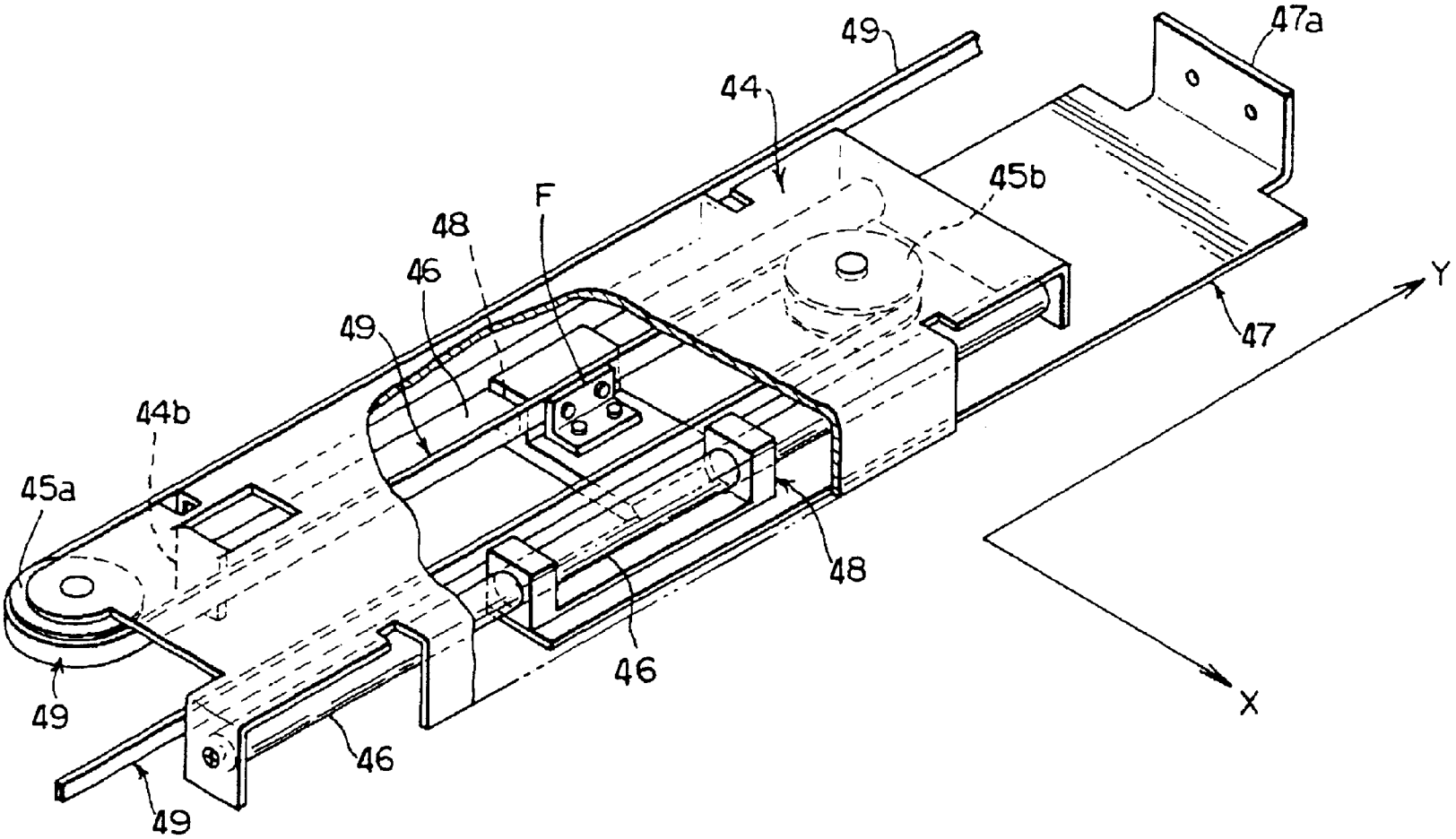
FIG. 8 is a perspective view of the carriage drive device partly broken to show the interior thereof.

As shown in FIGS. 7, 8 and 9, a pair of guide shafts 46, 46 are provided on the base carriage 44 as extended in the direction Y with a predetermined space provided therebetween in the direction X for enabling the distal end carriage 47 to reciprocatingly move in the direction Y.

The distal end carriage 47 has a pair of engaging portions 48, 48 which are in slide engagement with the guide shafts 46, 46 respectively. One of the engaging portions 48, 48 is fixedly connected to the belt 49 at the point F located between the two pulleys 45*a,* 45*b*.

As the carriage 44 is moved in the direction Y, the belt 49 is rotatingly moved around the pulleys 45*a,* 45*b*. The connecting point F is linearly moved with the carriage 44 in the same direction between the two pulleys 45*a,* 45*b*.

The distal end carriage 47 is moved in association with the movement of the belt 49 which is moved in association with the carriage 44. Therefore, the moving amount of the distal end carriage 47 is determined by the moving amount of the belt 49 which is twice of the moving amount of carriage 44 on the reason as has been already described hereinbefore in connection with the first embodiment of the invention. Therefore, the movement amount of the distal end carriage 47 is twice of the moving amount of the carriage 44. Namely provided that the moving amount of the carriage 44 is S, the movement amount of the distal end carriage 47 is 2S.

Figure 11:
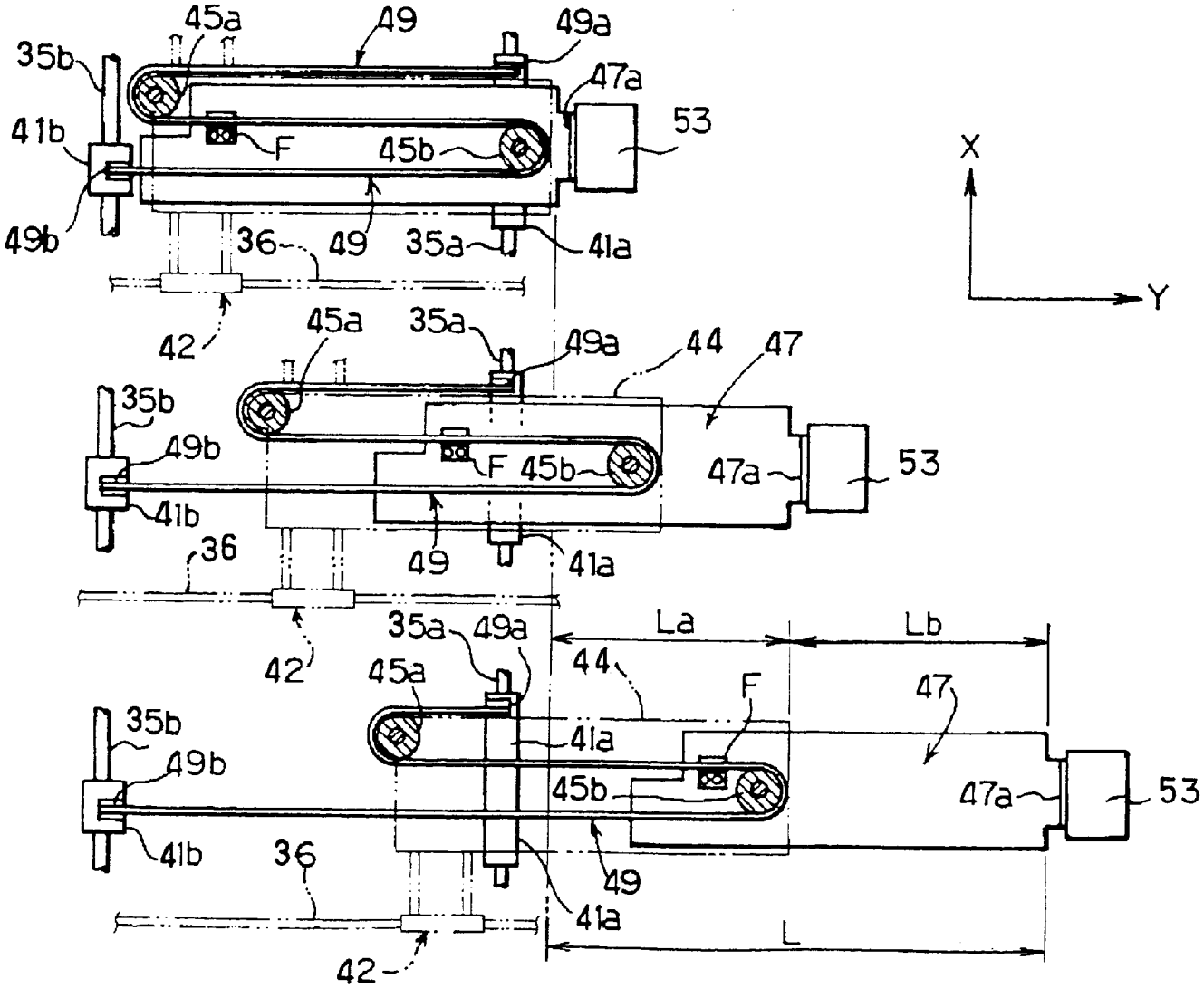
FIG. 11(A) through FIG. 11(C) are plan elevational views of the carriage drive device for explaining the operations thereof.

As shown in FIG. 11(C), the length L is an addition of a maximum moving amount La of the carriage 44 and a maximum moving amount Lb of the distal end carriage 47 to the right in the direction Y, wherein La equals Lb. In this connection, FIG. 9(B) shows in detail a part of a toothed 19 which is in mesh with a toothed pulley 15, which may be employed in place of the cord-belt 49 and the corresponding pulleys 45*a,* 45*b*. Further a wire may be used in place of the cord-belt 49.

Figure 12:
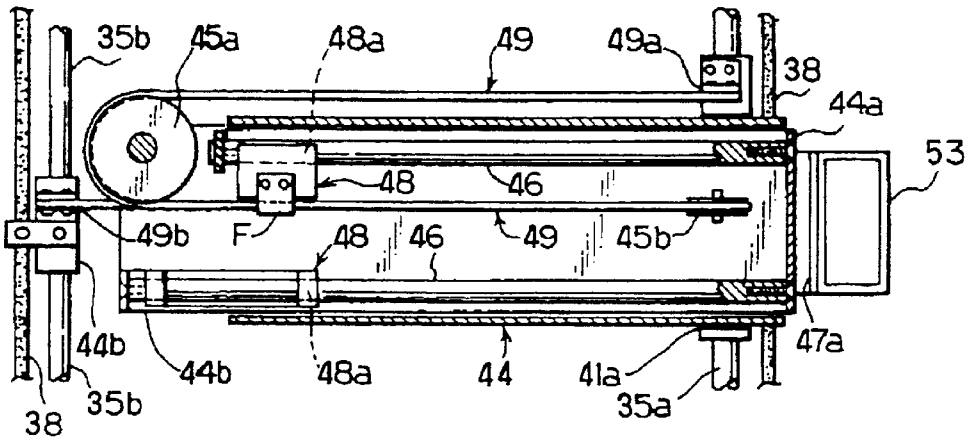
FIG. 12(A) is a perspective view of a slightly modified embodiment of the carriage drive device shown as partly broken.
FIG. 12(B) is a plan elevational view of the modified embodiment of FIG. 12(A)
Figure 12:
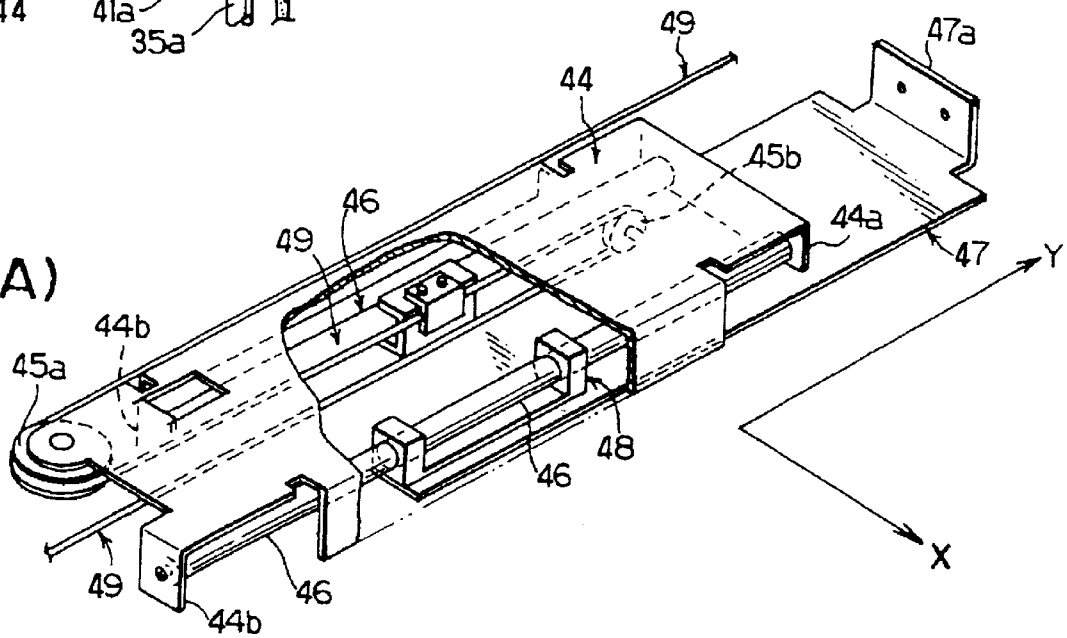

FIG. 12(A) and FIG. 12(B) show a modified embodiment wherein one of the pulleys 45*a,* 45*b,* that is, the pulley 45*b* is arranged to rotate in vertical plane and is mounted to the distal end carriage 47 while the position at which the end 49*b* of the belt 49 is fixed differs from the opposite end 49*a* in vertical direction.

Figure 13:
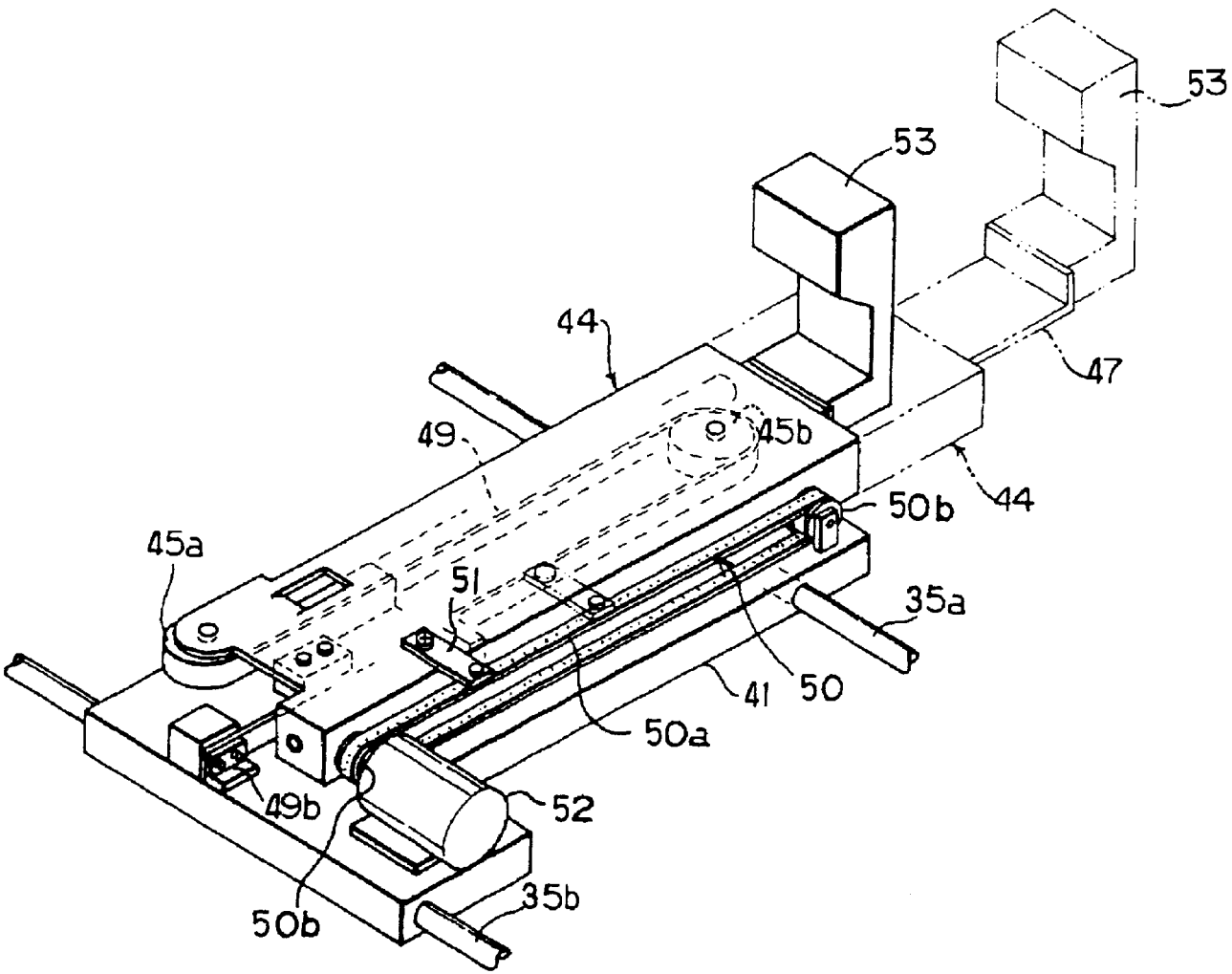
FIG. 13 is a perspective view of a third embodiment of the carriage drive device.
Figure 14:
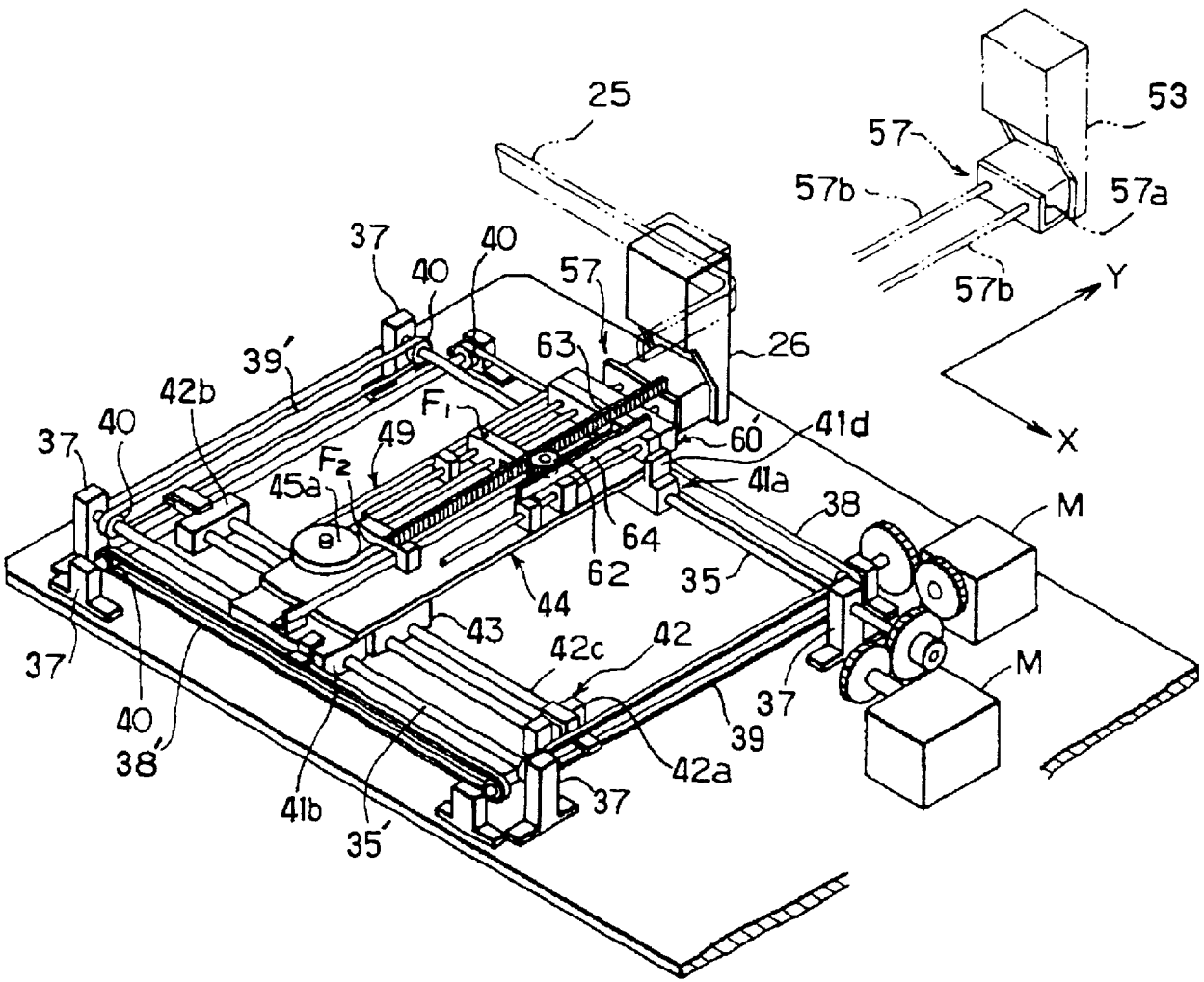
FIG. 14 is a perspective view of a fourth embodiment of the carriage drive device; in combination with X-Y drive mechanism.
Figure 15:
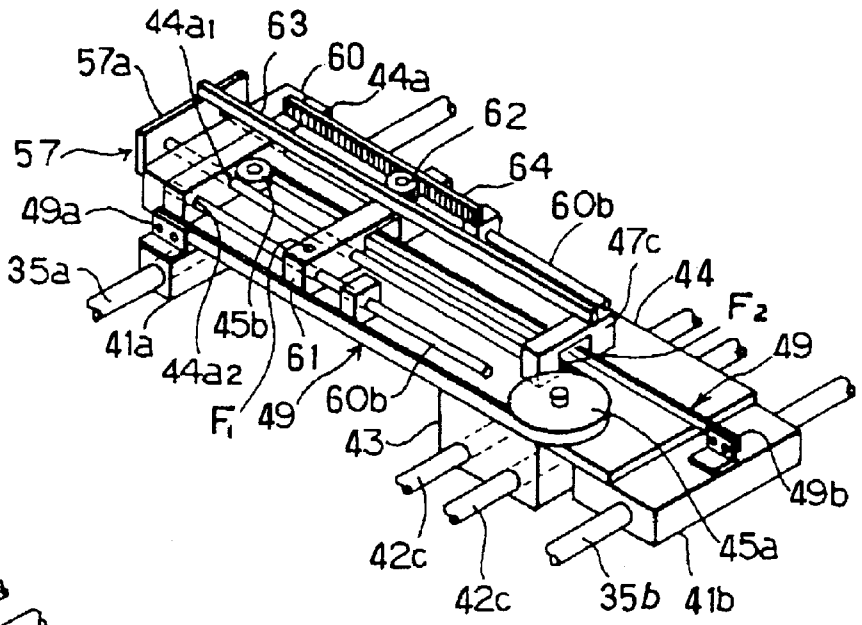
FIG. 15(A) and FIG. 15(B) are perspective views of the embodiment for explaining the operations thereof.
Figure 15:
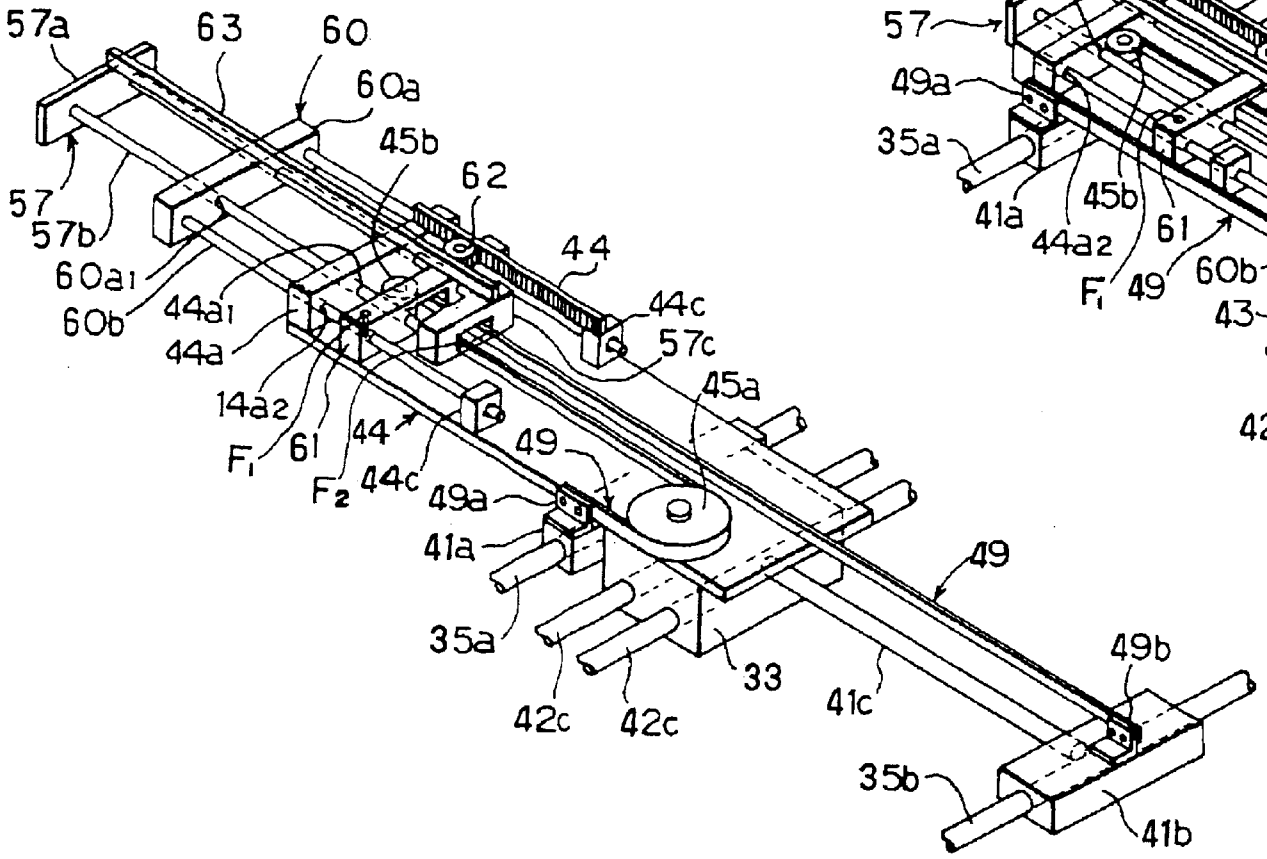
Figure 16:
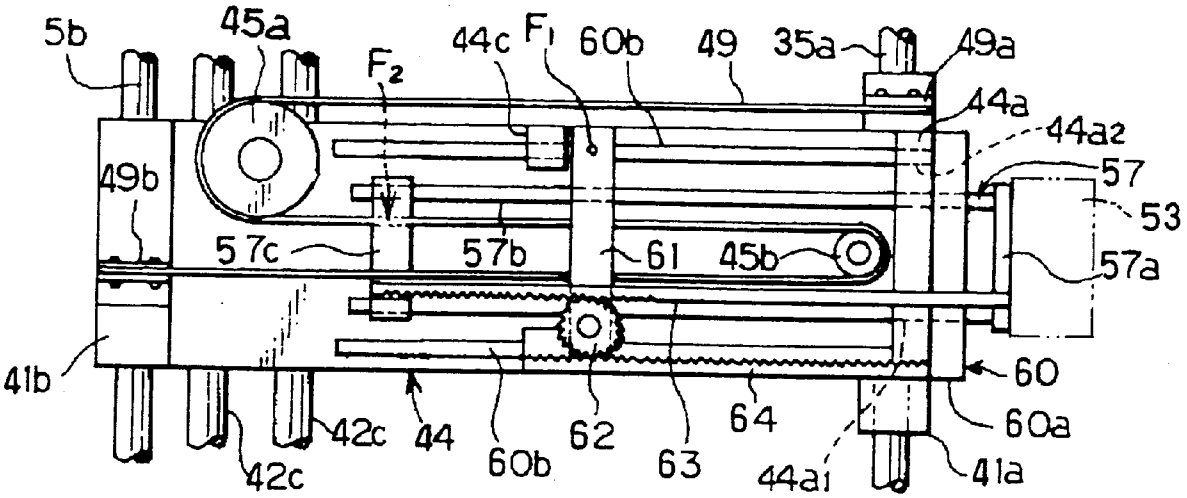
FIG. 16(A) is a plan elevational view of the embodiment wherein the carriage assembly is at the initial position.
FIG. 16(B) is a plan elevational views of the embodiment wherein the carriage assembly is moved to maximum extent from the initial position.
Figure 16:
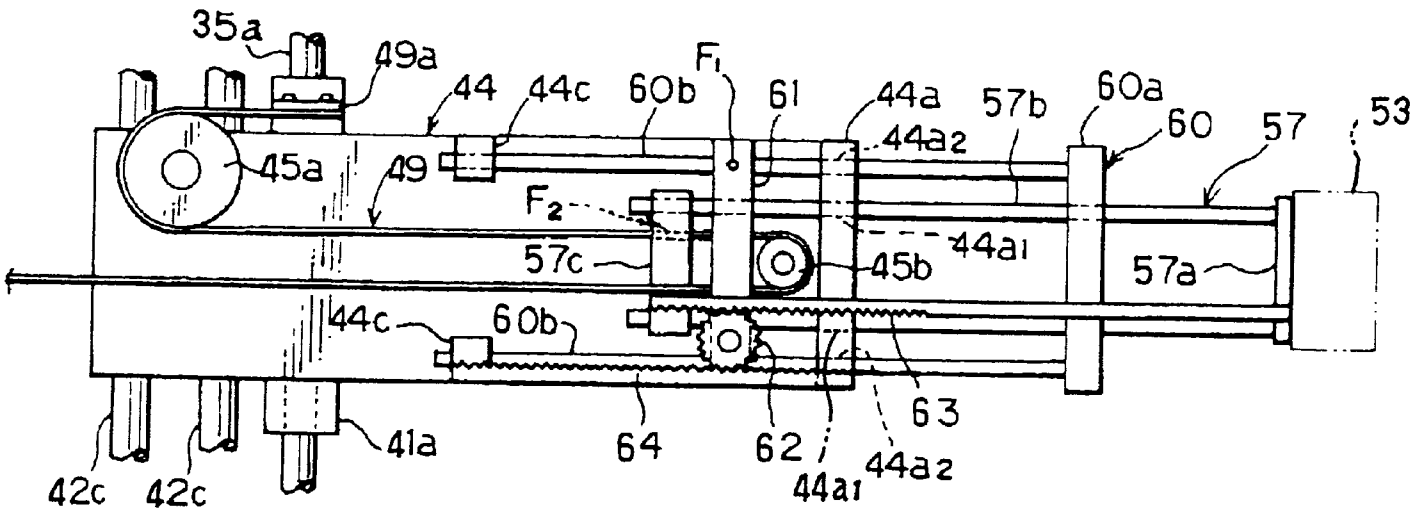
Figure 17:
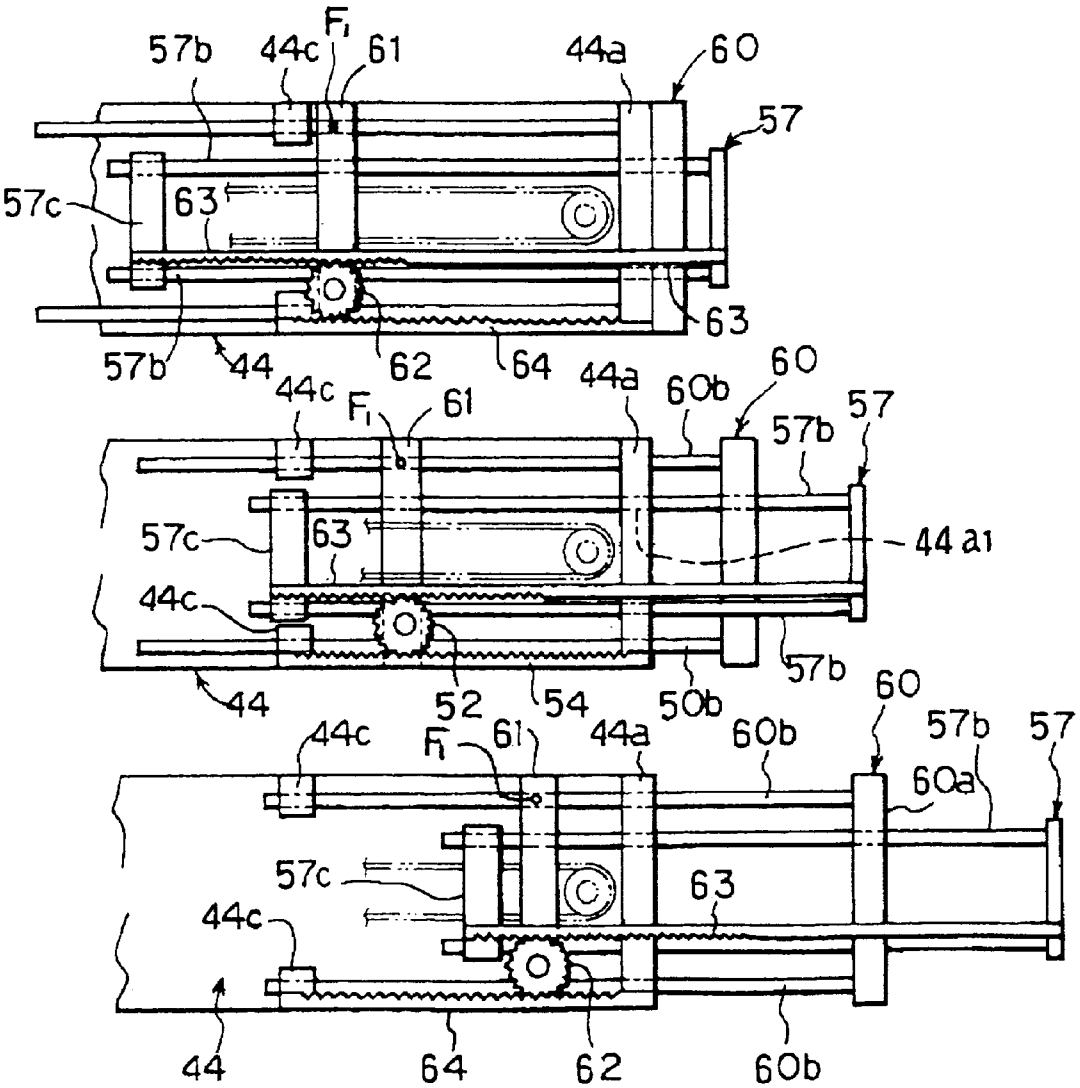
FIG. 17(A) through FIG. 17(C) are elevational views of the embodiment for explaining the operations of the carriage drive device.

FIG. 13 shows a third embodiment of the invention, wherein a carriage drive belt assembly 50 is mounted on the X-direction carrier 41 to move the carriage 44 in the direction Y. The carriage drive belt assembly 50 includes a drive belt 50*a* wound around a pair of pulleys 50*b* located on the X-direction carrier 41 as spaced from each other in the direction Y. The drive belt 50*a* is fixedly connected to the carriage 44 by means of a connector 51. One of the pulleys 50*b* is operatively connected to a drive motor 52 mounted on the X-direction carrier 41 to be rotated thereby. Thus the drive belt 50*a* is rotatingly moved around the pulleys 50*b* to slidingly move the carriage 44 in the direction Y.

A fourth embodiment of the invention will be described in reference to FIGS. 14 through 17, wherein an intermediate support assembly 60 is additionally employed in the embodiment as shown in FIG. 6. Therefore, the common elements are designated with the same reference numerals.

A carriage 44 has a guide 44*a* provided at the distal end thereof in the direction Y. A slide carriage 57 is composed of a pair of slide shafts 57*b* extending in the direction Y and having a support 57*a* secured to one end thereof for supporting an embroidering frame and having a stopper 57*c* secured to the opposite end thereof. The pair of slide shafts 57*b* are extended through a pair of guide holes 44*a*1 of the guide 44*a*.

The stopper 57*c* of the slide carriage 57 is fixedly connected to a cord 49 at a point F2, the cord 19 being wound around a pair of pulleys 45*a,* 45*b* located on the carriage 44 with a predetermined space provided therebetween in the direction Y and displaced in the direction X. The cord 49 has one end 49*a* secured to a carrier 41a and the opposite end 49*b* secured to a carrier 41*b*. The connecting point F2 is located at a part of the cord 49 extending between two pulleys 45*a,* 45*b*.

An intermediate support assembly 60 is provided, which is composed of a support 60*a* and a pair of shafts 60*b* extending in parallel with each other in the direction Y from the support 60*a* and passing through guide holes 44*a*2 formed at the guide 44*a* and further passing through guide portions 44*c* of the carriage 44 such that the intermediate support assembly 60 may slidingly moved relative to the carriage 44 in a stabilized condition. The slide shafts 57*b* of the slide carriage 57 are extended through guide holes 60*a*1 formed at the support 60*a* such that the intermediate support assembly 60 and the slide carriage 57 may be slidingly movable relative to each other.

The slide carriage 57 has a rack 63 extended in the direction Y and being opposite to a rack 64 provided on the carriage 44 and extending in the direction Y. A connector 61 is provided, which is extended in the direction X and has one end fixedly connected to one of the shafts 60*b* of the intermediate support assembly 60. The connector 61 has a pinion 62 mounted to the opposite end thereof. The pinion 62 is located between the rack 63 and the rack 64 and is in mesh with both racks 63, 64 such that the slide carriage 57 and the intermediate support assembly 60 may be moved in association with movement of the carriage 44 in the direction Y.

The pinion 62 and the racks 63, 64 are designed move the intermediate support assembly 60 half of a distance that the slide carriage 57 is moved. Thus the intermediate support assembly 60 supports the slide carriage 57 at the intermediate portion thereof in case the slide carriage 57 is moved out to a maximum extent.

The invention being thus described, it will be obvious that the same may be varied in many ways. Such variations or modifications are not to be regarded as a departure from the spirit and scope of the invention, and all such modifications are intended to be included within the scope of the following claims.

What is claimed is:

1. An embroidering sewing machine having an embroidering frame for holding the work to be stitched, a first drive means operated in synchronism with vertical reciprocating movement of a needle to move the embroidering frame in a first direction and a second drive means operated in synchronism with vertical reciprocating movement of the needle to move the embroidering frame in a second direction normal to the first direction, wherein:

at least one of said first and second drive means comprises;

a movable means which reciprocatingly moves in a limited area in said first or second direction, and a motion amplifying means to amplify the movement of said movable means and transmit it to said embroidering frame, thereby to move said embroidering frame in the range exceeding said limited area.

2. The embroidering sewing machine as defined in claim 1, wherein said limited area is an area in a base of said sewing machine or is a narrower area.

3. The embroidering sewing machine as defined in claim 1, wherein said limited area corresponds to a size of said drive means.

4. The embroidering sewing machine as defined in claim 1, wherein said one of said first and second directions corresponds to the depth direction of said sewing machine.

5. The embroidering sewing machine as defined in claim 1, wherein said first and second drive means are housed in a base of said sewing machine.

6. The embroidering sewing machine as defined in claim 1, wherein said first and second drive means are detachably attached to said sewing machine.

7. An embroidering sewing machine having an embroidering frame for holding the work to be stitched, a first drive means operated in synchronism with vertical reciprocating movement of a needle to move the embroidering frame in a first direction, a second drive means operated in synchronism with vertical reciprocating movement of the needle to move the embroidering frame in a second direction normal to the first direction, wherein:

at least one of said first and second drive means comprises:

a first movable member which moves in a limited area in said first or second direction, and a second movable member which moves in the same direction of said first movable member and in association with movement of said first movable member, thereby an amplified motion of said embroidering frame in an area exceeding said limited area is accomplished.

8. The embroidering sewing machine as defined in claim 7, wherein:

said second movable member is driven by the movement of said first movable member.

9. The embroidering sewing machine as defined in claim 7, wherein:

said first movable member has a pair of pulleys arranged thereon with a predetermined space provided therebetween and having an endless belt wound therearound, said endless belt having one side between said pulleys partly fixed such that the fixed part of said endless belt may be immovable in one of said first and second directions, said endless belt having the opposite side between said pulleys partly fixed to said second movable member such that the movement of said pulleys with said first movable member may move said second movable member with respect to said first movable member in said first or second direction.

10. The embroidering sewing machine as defined in claim 7, wherein:

said first movable member has a pair of pulleys arranged thereon with a predetermined space provided therebetween and having a cord belt wound therearound, said cord belt having both ends thereof fixed such that said both ends of said cord belt may be immovable in one of said first and second directions, said cord belt having a part between said pulleys partly fixed to said second movable member such that the movement of said pulleys with said first movable member may move said second movable member with respect to said first movable member in said first or second direction.

11. The embroidering sewing machine as defined in claim 7, further comprising an intermediate support means operated in association with movement of said second movable member to move in one of said first and second directions, thereby to support a part of said second movable member extended out from said first movable member.

12. The embroidering sewing machine as defined in claim 7, wherein said limited area is an area in a base of said sewing machine or is a narrower area.

13. The embroidering sewing machine as defined in claim 7, wherein said limited area corresponds to a size of said drive means.

14. The embroidering sewing machine as defined in claim 7, wherein said one of said first and second directions corresponds to the depth direction of said sewing machine.

15. The embroidering sewing machine as defined in claim 7, wherein said first and second drive means are housed in a base of said sewing machine.

16. The embroidering sewing machine as defined in claim 7, wherein said first and second drive means are detachably attached to said sewing machine.

17. An embroidering sewing machine having an embroidering frame for holding the work to be stitched, an X-direction drive means operated in synchronism with vertical reciprocating movement of a needle to move the embroidering frame in an X-direction which is a width direction of the sewing machine and a Y-direction drive means operated in synchronism with vertical reciprocating movement of the needle to move the embroidering frame in a Y-direction normal to the X-direction, the Y-direction being a depth direction of the sewing machine, wherein:

said X-direction drive means comprises;

a base carriage which is reciprocatingly movable in said X-direction, an X-direction drive source for driving said base carriage in said X-direction, said Y-direction drive means comprises:

an intermediate carriage which moves in said X-direction in association with movement of said base carriage and is movable in said Y-direction in a limited area in connection with the size of a base of said sewing machine;

a Y-direction drive source for reciprocatingly moving said intermediate carriage in said Y-direction; and a distal end carriage which is driven by movement of said intermediate carriage to move in said Y-direction with respect to said intermediate carriage, thereby to move said embroidering frame in said Y-direction in an area exceeding said limited area.

18. The embroidering sewing machine as defined in claim 17, wherein:

said base carriage is immovable in said Y-direction, said intermediate carriage has a pair of pulleys arranged thereon with a predetermined space provided therebetween, said pulleys having an endless belt wound therearound, said endless belt having one side thereof between said pulleys partly fixed to said base carriage and having the opposite side thereof between said pulleys partly fixed to said distal end carriage, said distal end carriage may be moved with respect to said intermediate carriage in said Y-direction in association with movement of said pulleys arranged on said intermediate carriage.

19. The embroidering sewing machine as defined in claim 17, wherein:

said intermediate carriage, said Y-direction drive source and said distal end carriage are mounted on said base carriage.

20. An embroidering sewing machine having an embroidering frame for holding the work to be stitched, the embroidering frame being operated in synchronism with vertical reciprocating movement of a needle to move in an X-direction which is a width direction of the sewing machine and in a Y-direction normal to the X-direction, the Y-direction being a depth direction of the sewing machine, said sewing machine comprising:

a base carriage which is reciprocatingly movable in said X-direction and in said Y-direction in a limited area in connection with the size of a base of said sewing machine;

a drive source for reciprocatingly moving said base carriage in said X-direction and in said Y-direction; and a slide carriage which is movable in association with movement of said base carriage, said slide carriage being driven by the Y-direction movement of said base carriage to reciprocatingly move in said Y-direction with respect to said base carriage, thereby to move said embroidering frame in said Y-direction in an area exceeding said limited area.

21. The embroidering sewing machine as defined in claim 20, wherein:

said base carriage has a pair of pulleys arranged thereon in said Y-direction with a predetermined space provided therebetween, said pulleys having a cord belt wound therearound, said cord belt having both ends thereof fixed such that said both ends of said cord belt may be immovable in said Y-direction, said cord belt having a part thereof between said pulleys partly fixed to said slide carriage, said slide carriage may be moved with respect to said base carriage in said Y-direction by the Y-direction movement of said pulleys moved in association with said base carriage.

22. The embroidering sewing machine as defined in claim 20, further comprising an intermediate support means operated in association with the Y-direction movement of said slide carriage to move in said Y-direction to support a part of said slide carriage extended out from said base carriage.

23. The embroidering sewing machine as defined in claim 20, the moving amount of said intermediate support means is less than that of said slide carriage.

* * * * *